US005518296A

United States Patent [19]

Compardo

[11] Patent Number: 5,518,296

[45] Date of Patent: May 21, 1996

[54] BLEACHER RECLINER CHAIR

[76] Inventor: Fred Compardo, R.R. 1, Box 87, Loami, Ill. 62661

[21] Appl. No.: 325,593

[22] Filed: Oct. 19, 1994

[51] Int. Cl.[6] ..... A47C 1/02

[52] U.S. Cl. ..... 297/378.1; 297/DIG. 2; 297/357; 297/256.1

[58] Field of Search ..... 297/357, 256.1, 297/252, 376, 352, 354.12, 378.12, 378.1, DIG. 2, 250.1

[56] References Cited

U.S. PATENT DOCUMENTS

| | | | |
|---|---|---|---|
| 1,729,687 | 10/1929 | Savage | 297/357 |
| 1,852,012 | 5/1932 | Hose | 297/250.1 X |
| 2,042,886 | 6/1936 | Ferguson | 297/354.13 X |
| 2,841,207 | 7/1958 | Sweeney | 297/252 |
| 2,993,675 | 7/1961 | Tatter | 297/252 X |
| 5,018,788 | 5/1991 | Cedergreen | 297/378.1 |
| 5,094,505 | 3/1992 | Nichols | 297/378.1 X |
| 5,222,782 | 6/1993 | Shrader | 297/252 |

FOREIGN PATENT DOCUMENTS

| | | | |
|---|---|---|---|
| 660989 | 7/1929 | France | 297/357 |
| 419881 | 4/1947 | Italy | 297/357 |

*Primary Examiner*—Milton Nelson, Jr.

[57] ABSTRACT

A bleacher recliner assembly for use as a chair or in combination with existing rows of collinear bleacher seats having a forward row and a rearward row of backless bleachers. The bleacher recliner assembly includes a back rest portion and a seat portion hingedly connected to secure the back rest relative to the seat in a first upward position or any number of reclining positions. A hinge device formed from slots in the seat portion and adjustable pins mounted on the back rest permits angular adjustment of the back rest.

8 Claims, 4 Drawing Sheets

FIG. 1
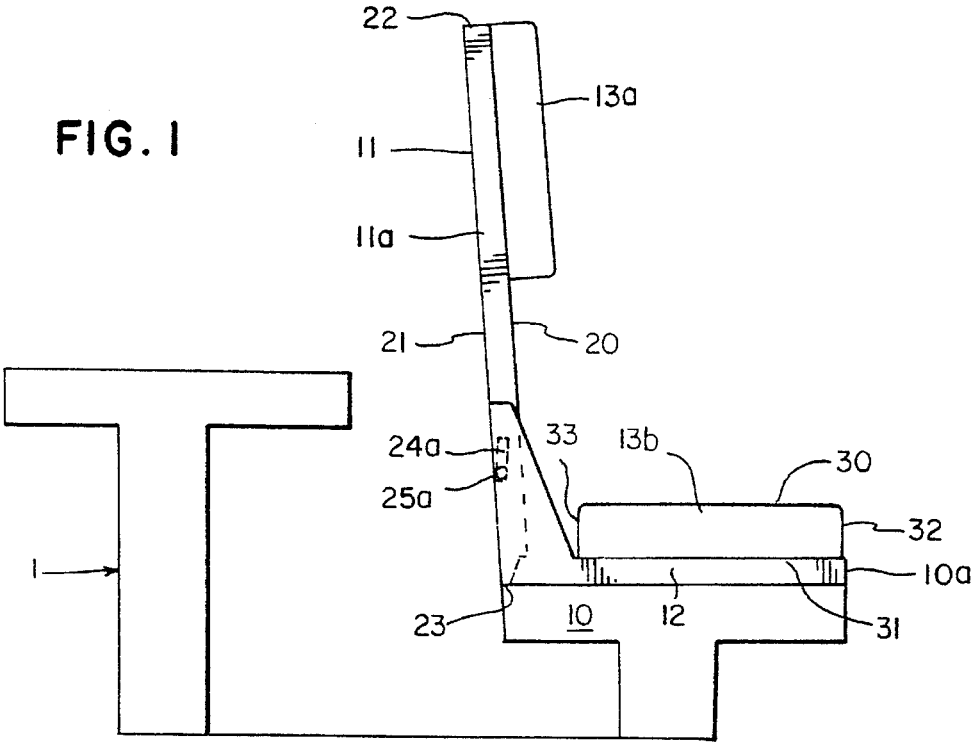
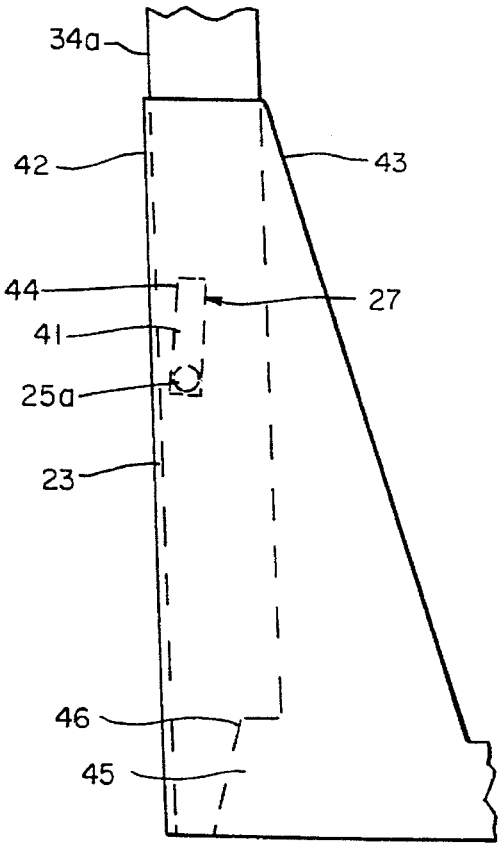
FIG. 2

BLEACHER RECLINER CHAIR

BACKGROUND OF THE INVENTION

The present invention relates in general to a folding seat for use with conventional and existing bleachers without backs. More particularly, the present invention relates to a bleacher chair assembly having a back rest that may be secured in a first position or may rely on a rearward bleacher for supporting the back in any number of other angled positions. A hinge structure is provided for movably adjusting the back relative to the seat portion.

Backless bleachers remain the most common type of seating arrangement for outdoor events in the United States. While modern stadiums with folding chairs are owned by groups expecting a full capacity crowd, more common outdoor events attract a less than capacity crowd. For the latter type of outdoor events, backless bleachers are used as a seating arrangement because they are easily assembled, disassembled, easily replaceable, and inexpensive relative to permanent seats.

Unfortunately, backless bleachers provide only a seat for the spectators. Where aluminum or metal bleachers exist, the seat is a conductor of the cold temperature, making the spectator as cold as the seat. During events which are long in duration, a spectator's back is strainfully tested. On a sunny day, the backless bleacher offers no backrest for relaxing. The failure of backless bleachers is especially noted when a small crowd occupies the bleachers for an all day event. The backless bleacher offers nothing in the way of comfort despite the scarcity of users.

Despite the problems created by backless bleachers, there have been no adequate solutions disclosed by the numerous attempts since bleachers were created. For example, the U.S. Pat. Nos. to Marchessault 815,190, Field 816,545, Amann 823,199, Hyde 859,560, Holm 1,293,778, and Leach 2,645,274 disclose folding bleacher seats having hinges, some of which have adjustable seat backs for supporting the back at a number of angles relative to the seat. Some of the more modern attempts to create seat backs for use on bleachers are shown in the U.S. Pat. Nos. to Mason 4,045,834, Filer 4,611,852, Maruyama 4,652,051, and Shrader 5,222,782. In Shrader, the inventor teaches the use of the rear bleacher seat to support a one-piece seat. However, the seat shown in Shrader fails to provide a seat that may be used on a bleacher with a full capacity crowd.

SUMMARY OF THE INVENTION

It is therefore an object of the present invention to provide a bleacher recliner chair.

According to the present invention, there is provided a bleacher recliner chair for use on backless bleachers having a first position for adjusting a back portion of the bleacher recliner chair in an upright position for attentively watching an event and in a number of reclining positions using the rear bleacher seat as a stop for reclining the back portion of the bleacher recliner chair in a number of angular positions.

A bleacher recliner chair assembly is provided having two pieces, a back portion and a seat portion made generally of plastic and having an integrally formed hinge assembly which permits positioning of the back portion relative to the seat portion in any number of positions. Cushions are provided on the seat portion and the back portion for comfort to the user.

The present invention provides a bleacher recliner chair that has uses during full capacity events and events having fewer spectators.

Other advantages and features of the present invention will become more apparaent from the following detailed description.

BRIEF DESCRIPTION OF THE DRAWINGS

The accompanying drawings illustrate the best mode presently contemplated by the inventor for carrying out the invention.

In the drawings:

FIG. 1 is a side view of the present invention.

FIG. 2 an enlargement of the left hinge portion of the present invention.

DESCRIPTION OF THE PREFERRED EMBODIMENTS

Figure 3:
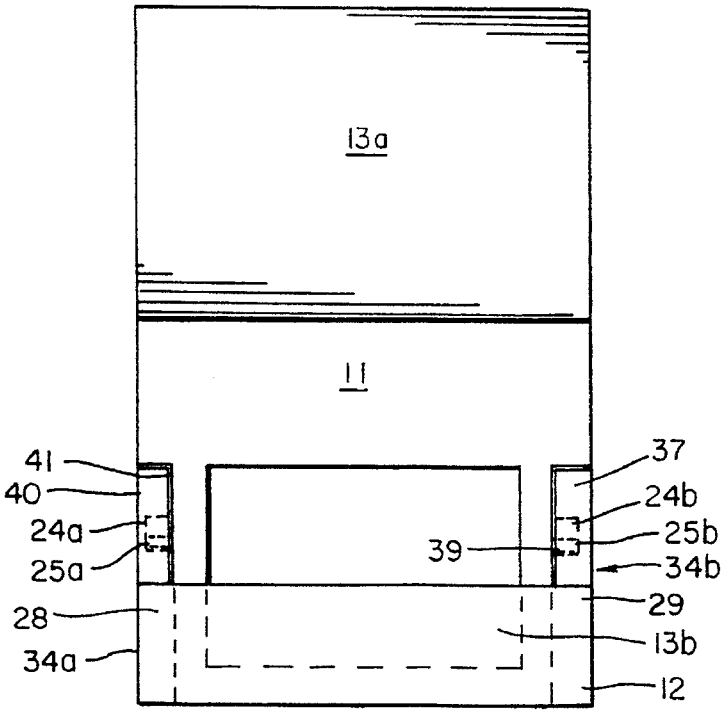
FIG. 3 is a front view of the present invention.
Figure 4:
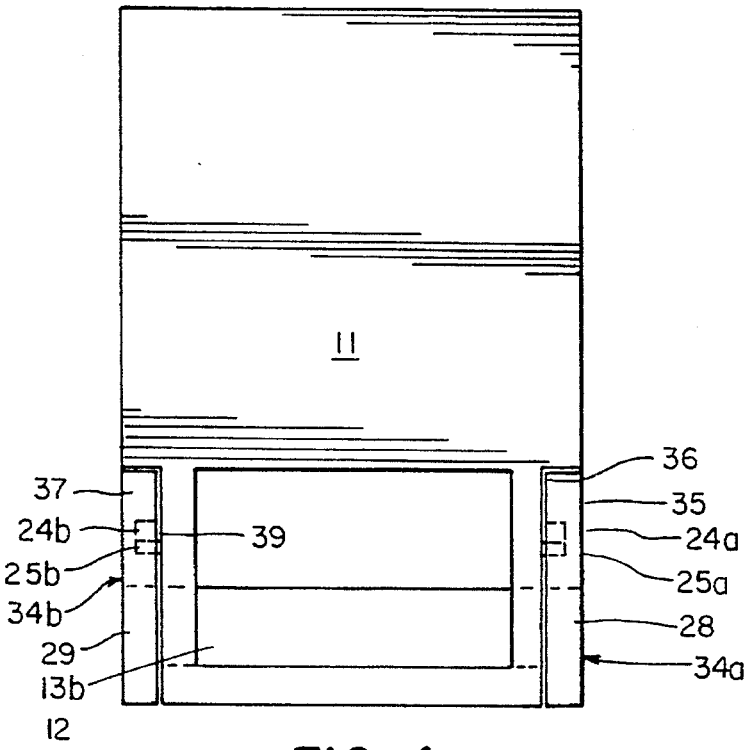
FIG. 4 is a rear view of the present invention.
Figure 5:
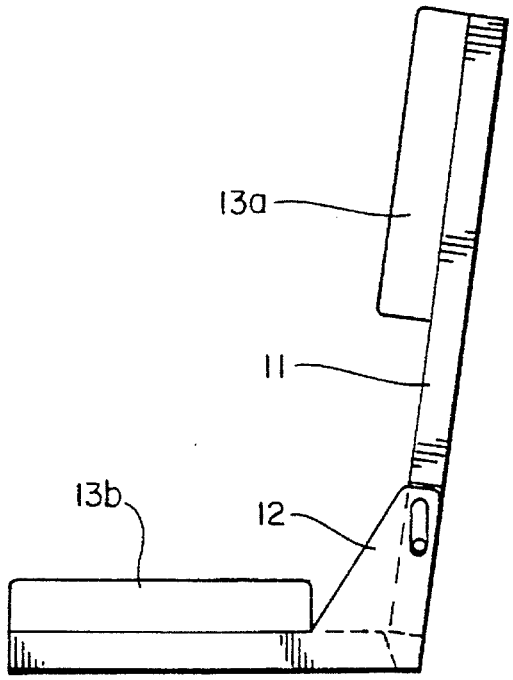
FIG. 5 is a side view of the bleacher recliner chair in upright position.
Figure 6:
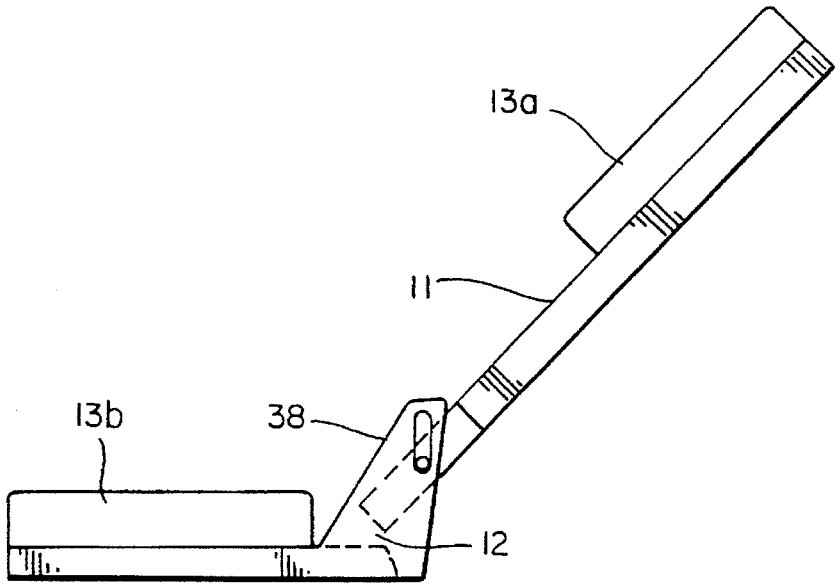
FIG. 6 a side view of the bleacher recliner chair in reclining position.
Figure 7:
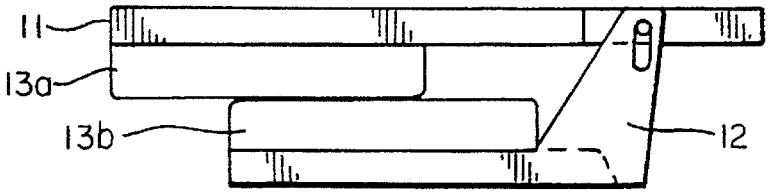
FIG. 7 is a side view of the bleacher recliner chair in folded position.

In the following, the bleacher recliner chair of the present invention will be described with reference to the drawings. In the description, the terms "left" and "right" are used with respect to a condition wherein the viewer is facing the front of the chair not sitting in the chair.

With reference to FIG. 1, a bleacher recliner assembly (10) is illustrated for use on backless bleachers (1). Backless bleachers are not of a standard size and are constructed of different sizes based on need. Moreover, the space between each bleacher row may vary bleacher size to bleacher size. Accordingly, the size of the present invention could be constructed for a particular sized bleacher section.

The bleacher recliner assembly is of two piece construction having a back portion (11) and a seat portion (12). Each portion includes a cushion (13*a*, 13*b*) made of polyurethane foam upholstered and attached to each portion. The foam is covered by any suitable foam covering which may or may not be waterproof material. In any event, the object of the construction is that the cushion material provide comfort to the spectator throughout a long event and not flatten out over a period of use.

Turning to FIGS. 1–4, the bleacher recliner assembly is illustrated in an upright position. The back portion (11) includes a back frame (11*a*), a front wall (20), and a rear wall (21). The walls form a top end (22) and a rear end (23) shown in dotted lines but hidden by the seat portion (10). Back cushion (13*a*) is glued on the front wall (20) near the top end (22). The back portion is made of molded plastic material and opening (24*a*, 24*b*) is formed in the back portion during the molding process. The back portion is integrally molded with hinge pin means (25*a*, 25*b*) for pivotally connecting the back portion to the seat portion. Hinge pin means (25*a*, 25*b*) are plastic pins or dowels which form part of hinge assembly (27). Left hinge pin (25*a*) projects from left side wall (28) and right hinge pin (25*b*)

projects from right side wall (29). The hinge pin assembly will be described in greater detail later.

Seat portion (10) includes a seat frame (10*a*), an upper wall (30), and a lower wall (31). The walls (30, 31) form a front end (32) and a rear end (33). Seat cushion (13*b*) is attached on the upper wall near the front end. The seat portion is also made of molded plastic material. Integrally formed with seat portion (10) is right upstanding member (34*b*) and left upstanding member (34*b*) which receive the hinge pins. As shown in FIGS. 2, 6, 7, and 8, left upstanding member (34*b*) also includes an outer wall (40), an inner wall (41), a rear end (42), and a sloping front end (43). A left socket slot (44) is formed in inner wall (41) for receiving hinge pin means (25*a*). Right upstanding member (34*a*) includes an outer wall (35), an inner wall (36), a rear end (37), and a sloping front end (38). A right socket slot (39) is formed in inner wall (36) for receiving hinge pin means (25*b*). Both slots are formed during the molding process and are elongated running perpendicular to the plane of the seat portion (10). The slots extend into each upstanding member but not therethrough, creating a strong sliding support base for each pin. The shape of each slot permits each pin to slide freely throughout the length of the elongated shape.

The seat frame (10*a*) has a stepped area (45) with undersides. (46)Each stepped area forms a pocket for receiving each upright member during seat-up use. As each stepped area receives each upright member, the bottom front face of the back portion meets the rear end of the seat portion to brace the seat in upright position. As shown in FIGS. 1–3 and 6–8, hinge pins are slid downwardly so they rest in the bottom of each elongated slot when the seat portion is in the upright position.

Figure 8:
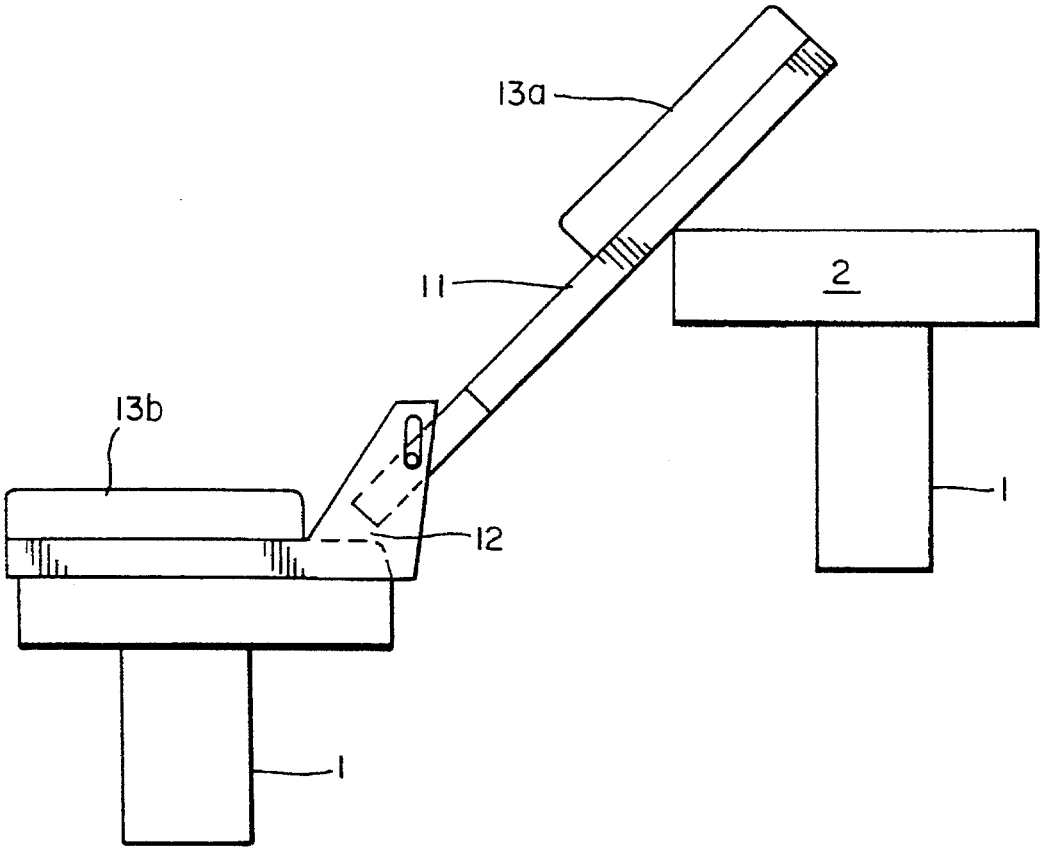
FIG. 8 is a side view of the bleacher recliner chair in reclining position against a rear bleacher seat.

As illustrated in FIG. 8, the bleacher recliner may be supported by a rear bleacher seat (2) in any number of reclining positions. The back portion is slid upwardly and pivoted so the back cushion tilts backwardly until the back portion rests on the rearward bleacher seat (2). The spectator may select any angle of rest for the back portion by moving the seat portion forward or backward on the bleacher seat.

What is claimed:

1. A portable bleacher recliner chair assembly for use on a bleacher having at least a front bleacher seat and a rear bleacher seat, comprising:

a seat portion integrally formed of molded plastic material, said seat portion including a seat frame and a pair of sloped upstanding members, each upstanding member having an inner wall, each inner wall having an elongated socket slot extending into said wall but not therethrough;

a back portion integrally formed of molded plastic material, said back portion having upright members and hinge pins for pivotally connecting said back portion to said seat portion, each pin freely slidable throughout the length of each slot, said seat frame having a stepped area with undersides to form a pocket for receiving each upright member during set-up use and, a back cushion attached to said back portion and a seat cushion attached to said seat portion.

2. A portable bleacher recliner chair assembly, as recited in claim 1, further comprising a back portion bottom front face for meeting a rear end of said seat portion to brace said chair in upright position.

3. A portable bleacher recliner chair assembly of claim 1 further comprising a back frame, said back frame connected to said seat portion by said hinge pins for resting said back frame on the rear bleacher seat in a reclining position.

4. The portable bleacher recliner chair assembly of claim 1 wherein said cushions are covered with waterproof material.

5. A portable bleacher recliner chair assembly for use on a bleacher having at least a front bleacher seat and a rear bleacher seat, comprising:

a seat portion integrally formed of molded plastic material, said seat portion including a seat frame and a pair of sloped upstanding members, each upstanding member having an elongated socket slot extending into said member but not therethrough;

a back portion formed of molded plastic material, said back portion having upright members and integrally formed hinge pins for pivotally connecting said back portion to said seat portion, each hinge pin being freely slidable throughout the length of each slot, said seat frame having a stepped area with undersides to form a pocket for receiving each upright member during non-use; and, a back cushion attached to said back portion and a seat cushion attached to said seat portion.

6. A portable bleacher recliner chair assembly, as recited in claim 5, further comprising a back portion bottom front face for meeting a rear end of said seat portion to brace said chair in upright position.

7. The portable bleacher recliner chair assembly of claim 5 further comprising a back frame, said back frame connected to said seat portion by said hinge pins for resting said back frame on the rear bleacher seat in a reclining position.

8. The portable bleacher recliner chair assembly of claim 5 wherein said cushions are covered with waterproof material.

* * * * *